US010045903B2

(12) United States Patent
Galitzer

(10) Patent No.: US 10,045,903 B2
(45) Date of Patent: Aug. 14, 2018

(54) SENSORIMOTOR DISCS FOR INFANTS AND BABIES

(71) Applicant: Sharon Galitzer, Potomac, MD (US)

(72) Inventor: Sharon Galitzer, Potomac, MD (US)

(73) Assignee: Sharon Galitzer, Potomac, MD (US)

( * ) Notice: Subject to any disclaimer, the term of this patent is extended or adjusted under 35 U.S.C. 154(b) by 472 days.

(21) Appl. No.: 14/720,792

(22) Filed: May 24, 2015

(65) Prior Publication Data

US 2016/0022525 A1 Jan. 28, 2016

Related U.S. Application Data

(60) Provisional application No. 61/999,253, filed on Jul. 22, 2014.

(51) Int. Cl.

| | |
|---|---|
| ***A61H 21/00*** | (2006.01) |
| ***A61H 1/00*** | (2006.01) |
| ***A61H 15/00*** | (2006.01) |
| ***A61H 23/02*** | (2006.01) |

(52) U.S. Cl.

CPC ..... *A61H 1/001* (2013.01); *A61H 15/00* (2013.01); *A61H 23/02* (2013.01); *A61H 2201/0103* (2013.01); *A61H 2201/0146* (2013.01); *A61H 2201/0165* (2013.01); *A61H 2201/10* (2013.01); *A61H 2201/1692* (2013.01); *A61H 2201/5058* (2013.01); *A61H 2201/5071* (2013.01)

(58) Field of Classification Search

None

See application file for complete search history.

(56) References Cited

U.S. PATENT DOCUMENTS

| | | | | |
|---|---|---|---|---|
| 3,311,935 A * | 4/1967 | Petty | A47D 9/04 5/109 |
| 5,342,113 A * | 8/1994 | Wu | A47D 9/02 297/183.3 |
| 5,376,053 A * | 12/1994 | Ponder | A63G 9/16 472/119 |
| 5,615,428 A * | 4/1997 | Li | A47D 9/02 5/104 |
| 6,343,994 B1 * | 2/2002 | Clarke | A47D 13/105 297/273 |
| 7,234,177 B1 * | 6/2007 | Drevitson | A45F 3/22 5/109 |

(Continued)

*Primary Examiner* — Stephen R Crow

(74) *Attorney, Agent, or Firm* — MAXVALUEIP LLC

(57) ABSTRACT

In one example, we describe a method and system for infant's development, which is a disc system, with various combinations and extensions. The brain is the only organ that constantly reorganizes itself based on experiences or lack thereof. Babies are born with millions of neurons. Through a process called "pruning", certain 'circuits' are fine-tuned through repeated practice and stimulation. This occurs from birth, throughout early childhood. The purpose of the SensiMo Disc is to provide an infant, e.g., typically, up to the 25 lbs. and/or 29 inches long, sensorimotor stimulation, while lying in a prone or supine position, with minimal active movement of the head or extremities. As the child lays supine or proneon, on the SensiMo disc, the child's tactile, vestibular, and proprioceptive systems are stimulated. This helps develop the child's sensorimotor system. Many other variations and combinations, plus advantages, are discussed.

2 Claims, 19 Drawing Sheets

(56) References Cited

U.S. PATENT DOCUMENTS

| | | | | |
|---|---|---|---|---|
| 8,083,601 | B2 * | 12/2011 | Speedie | A47D 9/02 472/119 |
| 9,279,486 | B2 * | 3/2016 | Wu | A47D 9/04 |
| 9,510,693 | B2 * | 12/2016 | Cordier | A47D 15/00 |
| 2016/0022525 | A1 * | 1/2016 | Galitzer | A61H 1/001 128/845 |

* cited by examiner

806

SENSORIMOTOR DISCS FOR INFANTS AND BABIES

RELATED APPLICATION

The current application is related to a provisional application 61/999,253, filed Jul. 22, 2014. We claim priority date to that provisional application. We also incorporate by reference all the teachings of that provisional application.

BACKGROUND OF THE INVENTION

An infant's positioning, when not being held by a parent, are integral for safety and to facilitate typical development. For conditions, such as torticollis, plagiocephaly, or for those who are born premature, positioning can make a big difference for their present level of function and development. As humans, our movements are all multi-planar and incorporate processing from many different areas of the brain. Humans constantly adjust their bodies in order to meet the changing demands of the environment, as we move within it. This opportunity is the same for all newborns, both demonstrating typical and atypical development. Thus, the resting place for an infant is a critical element for his or her health and well-being.

For example, according to the Center for Disease (CDC), one of every eight babies is born prematurely, prior to 37 weeks of gestation. That would equate to almost 13 million babies who are "at risk" for motor or cognitive challenges later on. The cost to support the special needs of these children equates to billions of dollars. What if we could minimize this by beginning early intervention, even before they begin to receive supportive services at home and in school, with a simple change to the way society/people use playmats. Gentle rhythmic shifts in weight for supporting the infant is a solution to this problem, and the infant's response to that can be soothing, stimulating, and not that much different than those comforting feelings and movements that the infant felt in utero.

Some of the products in the market are:

http://www.childrenstherapystore.com/versatile_tactile_air_sitting_cushion.html http://www.childrenstherapystore.com/cando_vestibular_balance_disc.html http://www.childrenstherapystore.com/dynamic_round_seating_cushion.html http://www.bernell.com/product/5097/276 (for a balance board)

Amazon.com, SPRI Step360, Pro Trainer, Balance Board

However, the invention and embodiments described here have not been addressed or presented in any prior art.

SUMMARY OF THE INVENTION

In one embodiment, we describe a method and system for infant's development, which is a disc system, with various combinations and extensions. The brain is the only organ that constantly reorganizes itself based on experiences or lack thereof. Babies are born with millions of neurons. Through a process called "pruning", certain 'circuits' are fine-tuned through repeated use and stimulation. This occurs from birth, throughout early childhood.

The purpose of the SensiMo Disc is to facilitate the shifting of the center of gravity for an infant, e.g., typically in a baby up 25 lbs, and/or 29 inches long, and provide sensorimotor stimulation, while lying in a prone or supine position, with minimal active movement of the head or extremities. As the child lays and moves in supping and prone on the SensiMo disc, the child's tactile, vestibular, and proprioceptive systems are stimulated. This helps develop the child's sensorimotor system.

Facts about brain development:

- Every time a child feels, sees, smells, or move, their sensorimotor system is fine-tuned.
- The environment has a direct impact on the brain development.
- A newborn's brain is only of the size of that of an adult. It will grow to 80% of the adult size by the age of three, and to 90% by the age of 5.

Please refer to (www.Zerotothree.org) for more information.

There are many children at high risk, including those who are born prior to 34 weeks gestation, and as early as 23 weeks of gestation, low birth weight and very low birth weight infants, infants with neurological disorders, and infants with extended hospitalizations early on in their lives.

The SensiMo Disc can serve as a source of stimulation to a child's central nervous system, who may be experiencing developmental delays, even when they are at rest. Repetitive practice with movement facilitates tolerance to handling, motor development, and circuitously, enhances self-regulation and speech development.

Infants begin to develop their sensorimotor system immediately following birth, and fine-tune it as they grow older. Random active movements of their eyes, head, and extremities each help the infant to use their bodies in space. That space could be in their parent's arms, on the floor, and sometimes in a bouncy seat. Sensory discrimination occurs as the child compiles information about the various surfaces they encounter, and the way it makes their bodies feel, different in each case.

At times, the child will be on a soft surface, such as a bed or as swing, and at times, they may play on the floor. The sensory system and the motor system are symbiotic. A child moves, because they feel. The more a child feels, the more they will move.

The Sensimo disc gently shifts as the child's COG (center of gravity) changes each time the child moves his/her eyes and head to search for a parent or toy, or to visually explore their environment, or lifts his/her head during "tummy time", or reflexively kicks an arm or a leg. The moving surface of the Sensimo disc changes the amount of sensorimotor feedback into a child's central nervous system.

For children with atypical development or a lack of active movements, this device is even more integral in order to facilitate movement and the slightest change in position. If all of the aforementioned skills are delayed by prematurity, illness, or developmental delay, then the SensiMo disc can serve as a tool to stimulate their sensorimotor system, in correspondence to their own movement. Small movements from the child can initiate a response from the supporting surface, thereby, making each active movement a learning experience that may encourage further similar attempts in the future. The child will experience weight shifting, a sense of weight shift in line with eye gaze, head rotation, or random active movement of extremities. The dynamic changing surface will provide the child with a different sensory feeling each time their movements change, thereby, providing a unique learning system for any central nervous system.

The SensiMo disc will respond to movements in all directions, with the slightest shift of weight at any point on the child's body. This feedback system is the earliest form of simulating weight shift for a child, even prior to their being able to do it for themselves, and may add to the variety of their movements. Weight shifting is necessary for maintaining an upright position, reaching, rolling, sitting, crawling, standing, and walking. Beginning early with simple interventions may prove to have long term benefits in a child's development.

Materials: The disc will be made out of either MDF or some other strong plastic substance, in one embodiment. In one embodiment, it will range from 26-30 inches in diameter, positioned between ⅛ to ¼ of an inch from the floor, and optionally, is covered with ⅛-¼ inch of dense foam. The top side will have a lip to minimize lateral movement off of the surface. The material that covers this unit will be in high contrast colors, much like a shower cap, and comprises machine washable fabrics, in one embodiment. This disc will work in conjunction with already existing material playmats that currently exist in today's market, as supplement or complementary features.

The base (100) of the SensiMo disc will be a hemisphere of inflatable plastic rings, similar to an inner tube. The device will have a plastic top, with some padding (e.g., rubber or plastic, such as Swiss Ball or Bosu Ball material), with a threaded indentation. The top of the spherical base would also be threaded. This would allow for the spherical base to be adjusted closer/further from the plastic resting surface, where the baby would be placed, which would make the device more/less stable. The bottom (102) side may also be made of softer plastic base with striated indentations. Plastic surface of bottom will be determined by torque and viscosity of surface material.

In one embodiment, this unit can be enlarged for older children to practice sitting and standing balance. Weighted center (e.g. using sand) will decrease the speed with which the disc moves. The disc can be anchored or fixed to the ground, using chain, tape, Velcro, hook, lock, string, rope, zipper, weight, legs, frame, or tie.

DETAILED DESCRIPTION OF THE PREFERRED EMBODIMENTS

Figure 1:
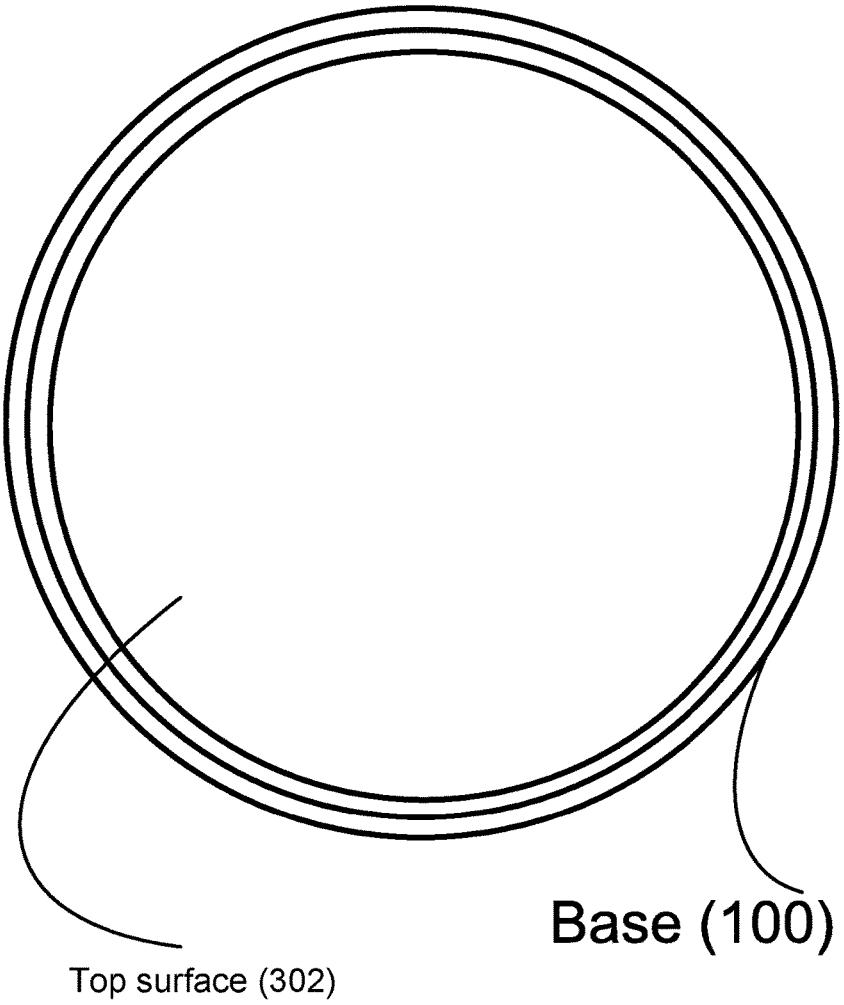
FIG. 1 is for one embodiment, as an example, for circular disc or pad or device or SensiMo Disc.

The "SensiMo Disc™" (our disc/invention) provides a parent with an alternative and stimulating resting place for an infant, aside from the floor, that gently shifts in response to their movement and weight shifting. This feedback stimulates the sensorimotor area of the brain which begins to develop immediately after birth. This product is helpful for sensorimotor feedback for newborns, but especially useful for infants who do not have the frequency or the range of movement as those of typically developing babies. Premature babies or children who have special needs or conditions that limit their mobility would benefit the most from the constant rhythmic external feedback from their slightest movements, to support muscle and brain development. That saves billions of dollars for the health cost, and it also supports the general health of infants and society as a whole, which is invaluable. This device can also be utilized in the home or institutions that care for babies, including hospitals, daycares, and orphanages, requiring minimal instruction and cost of training.

Infants develop their sensorimotor system immediately following birth, and fine tune it, as they grow older (Table 1). A child moves, because they feel. The more they feel, the more they will move. Through random active movements of an infant's eyes, head, and extremities, the infant learns to use their bodies in space. For most infants, that space is typically their parent's arms, on the floor, or sometimes a bouncy seat.

Table 1. Typical sensory motor skill development.

TABLE 1

Typical sensory motor skill development.

| Age | Sensorimotor Skill Development |
|---|---|
| Newborn | Attempts to track an object within 6 inches (optical righting). The child tracks more efficiently with their eyes, if their head is supported. Beginning hands to mouth. |
| 2 months | Active head movement in supine (Body On Head reflex). The child can visually track across midline. Beginning to bring toys and hands to mouth and face. |
| 4 months | Neck on Body reflex. Eyes can converge, track horizontally and vertically. Child can begin to dissociate eyes movement from head movement. |
| 5-7 months | Child uses vision or a comparable sensory system to guide their movements towards toys or people. Tilting reaction in supine. |

For infants with sensorimotor delays, the SensiMo Disc alerts the child's CNS by gently shifting the child's center of gravity in response to the child's own movements, as slight as they may be, visually examining their surroundings, searching for a parent, or toy, or reaching for a toy, or rotating its head from side-to-side, or lifting its head during "tummy time," or actively moving an arm or leg. The dynamic changing surface of the SensiMo Disc provides the child with a different sensory feeling each time its movements change, thereby, providing a unique feedback system that can tap in on any developing brain and encouraging different sections of the brain to work in conjunction with one another.

The infant learns about movement as they continuously compile information about various shifts and reactions to the feeling of movement. This creates a larger memory pool to draw from when the infant must react to a changing surface. The Sensimo disc motions will translate into more of these feelings and experiences, as the infant acts on it numerous times during their play time on the floor. Simply stated, the baby learns from responding and reacting to the surfaces they encounter and how it makes their bodies feel. This feedback system provided by the SensiMo Disc can provide an early form of simulating weight shift for a child, even prior to their being able to do it for themselves, and may add to the variety of their movements, for a faster and healthier development of the infant. Weight shifting is a core principle for infants that is necessary to maintain upright positions, knowing where one's body is in space, reaching, rolling, sitting, crawling, and eventually, standing and walking.

In one example, babies may be placed on their stomachs or backs, while at rest. It may be used by caretakers, family or clinicians to use with babies in order to stimulate their sensory and motor system, which even at an early age can stimulate the brain. This encourages the baby to feel feedback from a minimal amount of movement, and may emerge as the initial stimulant to teach an infant a cause-and-effect strategy for the future learning. This feedback is in the form of sensory, auditory, and mobility. A small shift in weight will shift the surface, and stimulate the babies to feel sensory input to a different part of their bodies.

In one embodiment, we have the following options:

1. Sensimo disc (301)
2. Sensimo mat
3. Air mattress (300)
4. Making a play mat work in a 3-dimensional, multi-planar way. If the baby shifts weight by turning his head side-to-side, this shifts the center-of-mass from the center, and the surface moves, possibly by few millimeters.
5. Either through honey comb surface on bottom, "bosu" type bottom, or plastic air channels/tubes on the bottom, with rings around periphery.
6. Tummy time position for the baby.
7. Less than ¼ off the ground, as one example.
8. Lip around periphery, as one example.
9. Non-toxic material, as one example.
10. Channels filled with air in columnar fashion. (For a mat, it looks like a float for pool.)
11. Surface has textures, soft and crinkly.
12. Tabs/rings around the side to connect rings and toys.
13. Must accommodate up to 25 lbs. lbs and be 28-30 inches in diameter, as one example. (Note: A 5-month average height is 25-26 inch long, with weight of about 15.5 lbs.)
15. 34×30 inch$^2$ mat.
16. 27×25 inch$^2$ play mat.

In one embodiment, we have the following options:

1. The level is lower, toward the ground
2. Bottom sphere surface will either be dimpled or flat.
3. Bottom sphere surface may be air
4. Bottom sphere surface may be kinetic sand (too heavy)
5. Hinge in the center for folding
6. Lip must be higher than foam
7. Crinkly cellophane paper under surface for auditory stimulation, as well, for babies.
8. 360 degrees of freedom
9. Can be used under current play mat
10. Firm surface, e.g., plastic, over inflated disc
11. Inflated disc can control the speed of movement

Practical Examples

In the field of rehabilitation, the philosophy and the scientific findings have evolved for over many decades. Theories such as pruning and neuroplasticity were ground breaking concepts that drove many new treatment techniques. The central nervous system was no longer considered a static system. There was room for new neuronal growth and connections which could have an impact on movement, speech, and learning. However, it was also apparent that the delivery model, including frequency, intensity and duration also have an impact on brain development. We realized that one, two or more sessions a week of "therapy" were more effective, if paired with parent/caregiver participation. The many hours that a caregiver interacts with a child can be imbedded with therapeutic games, activities and positioning that would facilitate the development.

In typical developing babies, the sensorimotor system is one of the first to develop. The tactile sense begins to develop in utero as the neonate strokes its face and sucks its fingers, often right greater than left. Then, as soon as a child emerges into the world, they begin to move. Each movement is an opportunity for an infant to learn about their body's effect on the environment and vice versa. Movement begins as spontaneous, mostly organized by a hierarchy of reflexes. However, these reflexes compliment the concepts of survival and adaptation in the sense that turning ones' head side to side can clear their airway, and eyes on head reflexes allow the infant to move their head towards the action. The quality of movement is often writhing, or explosive, and frequently uncontrolled.

Movement begins as whole body movements, and gradually become refined movements, which matures into controlled graded movements that allow children to play independently and complete activities of daily living, such as self-feeding and self-care. This can only occur with practicing movement over and over again to refine the neuronal connections, by a process call pruning, and use the most effective neuronal pathways to activate the most efficient group of muscles to work together to accomplish any given task. This practice occurs immediately after birth, as a newborn touches their face with fisted hands, and occurs each time they swat at toys, when placed on any supporting surface.

Each year over three million babies are born (from CDC, http://wwvw.cdc.gov/nchs/fastats/births.htm), and of those births, 11.5% are born pre-term. In addition to that, there are over 300,000 babies who receive early intervention services through Part C services, as offered through the Individual with Disability Education Act (IDEA). (See: http://nichcy.org/babies/history.) There are probably even more children who have not been identified by the system who are developmentally delayed. The government realized that early intervention to support the development that occurs during the first three years of life may better prepare all children, even those with developmental delays, for school and life. We share this belief and have developed a product to enhance peripheral feedback into the CNS, from a baby's natural movement.

Newborns do not actively roll, play or interact with their environment, until their nervous systems mature. There are numerous studies that support the strong correlation between cognitive development and motor. This product can be used from birth up to weight and height limits previously mentioned, as an example, because development does not follow a linear progression for all children, and therefore, intervention should begin early, in order to enhance the sensorimotor feedback associated with early jerky reflexive movements that begin at birth.

The first stage of development is, in fact, the sensorimotor stage, when a child obtains information about their work and their environment by sensory experiences. It is an important phase when the environment often has more of an impact on the child, including sounds, touch and movements. There are numerous studies to support early movements with executive functioning and cerebellum development. The SensiMo disc creates enhanced opportunities for the newborn and infant to receive feedback from the environment from self-initiated movements. The child's active participation in the Disc creates an active learning environment from the start.

The purpose of the Sensimo Disc is to provide real and spontaneous feedback to a newborn sensorimotor system about their movement, each time the infant produces any type of shift in his/her center of gravity. In newborns and infants, this supporting surface is often the floor or a bed. With the use of the SensiMo disc, the supporting surface will move naturally in combination with each of the active movements that the child produces. For every active movement that the newborn creates, the shift of the supporting surface will create a new feedback loop of information from the peripheral nervous system and feed-forward into the central nervous system.

Each time the child turns their head to gaze towards a familiar adult, touch their face, or move an extremity, the SensiMo Disc can magnify the feedback the child receives from each of their movements, thereby, giving them more information about their environment. When the child moves, the shift in the center of gravity (COG) translates down to the supporting surface, and in turn, produces forces on the body touching the supporting surface of the device. This changes on a constant basis.

The SensiMo Disc can be used with typical developing children to compliment typical development. But this device is even more important for atypically developing infants who may not have the range or frequency of movements similar to that of a typically developing child. In addition, children with developmental delays are often stuck in this phase for a longer period of time. The SensiMo Disc can serve as therapeutic tool for positioning that will provide instantaneous feedback to any child that produces any active movement including active movement of an extremity or turning head side to side. The shift in COG will translate down to the supporting surface, and replace a static supporting surface, such as the floor, into an interactive supporting surface. This will give the body different feedback each time the infant moves, on a constant basis, as one example. This device can be especially meaningful in homes, institutions, states and countries that may not have access to ongoing support for babies to actively move and learn in their environment, due to poverty or caretaker ratio.

Appendix 1 shows the typical designs and patterns on the device or apparatus, with top view. Appendix 2 shows the side and top view, with the lip, multiple rings (801 of FIG. 8), curved surface, stacked (801 of FIG. 8) layers, and flat surface. These are the variations for the structure and design for different embodiments.

In one embodiment, the SensiMo Disc is created with a low COG, wide surface, lip for protection of child on the supporting surface, and using materials and design that minimizes movement and the change of movement. The goal for this device is to be used in the general populous for all newborns, as well as children who have developmental delays. In one embodiment, this device will not have any moving or electronic parts. In other embodiments, it has moving or electronic parts. It will be light and transportable.

In one embodiment, the bottom of the SensiMo disc will either contains dimples on a gel surface, contain kinetic sand, or inflatable chambers, or simply water or gel. In one embodiment, the device meets with specifications to accommodate babies up to 29 inches long or 25 pounds, but will be able to withstand forces of up to 60 lbs.

In one embodiment, with modifications of this device, if there are infants that would benefit from a larger supporting surface, the area or diagonal or dimensions can scale, or become larger. In one embodiment, the bottom of the SensiMo Disc is advised to work on a carpeted surface, only, in order to increase the friction and minimize the speed of movement.

In one embodiment, the surface will be flat, contain a foam that has a stabilization surface tension. In one embodiment, the plastic on the bottom, spherical portion of the SensiMo Disc, will be comprised of a material that has a high friction. The supportive lip (101) around the flat surface will act as a safety feature. The cover of the flat surface will be washable, interchangeable, and visually stimulating, with fun and colorful designs for infants.

The newborn/infant can be placed on the supporting surface, in a prone or supine lying positions. Supporting Velcro straps can be attached as needed, for securing the infants. As the baby looks around, touches their face, kicks their legs, or lifts their arms, the COG is shifted, the device moves, and the baby receives the feedback through their sensorimotor system. The device can be used in conjunction with some type of mobile communication, e.g. smart phones or remote cameras, for reaching or monitoring, or while the child is holding a toy with one or both hands. The mechanical or electronic parts can be managed, controlled, or adjusted remotely, as well.

Precautions would include: 1. Constant adult supervision of child, while they are on the SensiMo Disc. 2. Device is only appropriate for children who are not yet rolling, as one example.

In one embodiment, the device is a simple design, yet a powerful tool that can help both typically developing children and those with different developmental progressions. The SensiMo Disc can serve as a tool to link the motor and sensory systems, to support learning and support motor development. More importantly, it can be used safely by both laymen and professionals in any type of settings. (This device can serve universally for all types of infants in a variety of settings.)

The elastic potential energy is expressed as the following:

$$F=kx \qquad \text{(Hooke's Law)}$$

where k is the stiffness coefficient or force constant,
x is distance of displacement, and
F is the elastic force.

$$E_p=(1/2)kx^2$$

where $E_p$ is the elastic potential energy.

As is well-known (see e.g. Wikipedia.org or any physics book), another parameter is called modulus, which measures the amount of force per unit area (stress) needed to achieve a given amount of deformation. The units of modulus are Pascals (Pa) or pounds of force per square inch (psi, also $lbf/in^2$). A higher modulus typically indicates that the material is harder to deform. The second type of parameter measures the elastic limit. The limit can be a stress beyond which the material no longer behaves elastic and deformation of the material will take place. If the stress is released, the material will elastically return to a permanent deformed shape, instead of the original shape. So, we want to be below such limit, to have a proper return to the original shape.

For example, for Young's modulus parameter, we have a value of 0.8 $kg/mm^2$ for rubber and 300 $kg/mm^2$ for vinyl plastic. We can use any material such as rubber, plastic, elastic materials, petrochemical, synthetic, natural, foam, Anti-static Packing Peanuts, cotton, wool, polyester, vinyl, feather, fluffy material, porous material, hollow material, sponge type material, cotton ball material, popcorn as packing material, fine sand, wood chips, paper shred, polymer, paper packaging material, bubbling packaging material, clothing, fabric, foam with memory, foam without memory, small metal springs, two large parallel plates with springs or foam or balls or marble in between, mini-ping-pong balls, or similar materials, for cover and inner material, as long as the total elasticity is below the elastic limit, to avoid permanent deformation.

For example, an infant may be 10 kg (mass), with 40×20 $cm^2$ cross section on his or her back. Then, we have:

weight of 10×9.8=98 (Newtons) for the infant.

The cross section is 800 $cm^2$ or 0.08 $m^2$.

Thus, the pressure, P, on the disc is:

$P$=(weight/cross section area)

$P$=98 N/0.08 $m^2$ $P$=1225 $N/m^2$=1225 Pa (or Pascal)

So, we should have material which can withstand such a pressure. In addition, we can add more pressure for margin for pointy parts of the body, e.g. fingers, which can have locally much higher pressure in a very small area, e.g., 3 to 5 times higher than above, or about 5000 Pa pressure on the material below. In addition, the material must be soft and durable, plus washable or changeable, e.g. cotton covering, so that it does not irritate the skin of the baby, as mentioned for some examples in the list above.

Figure 2:
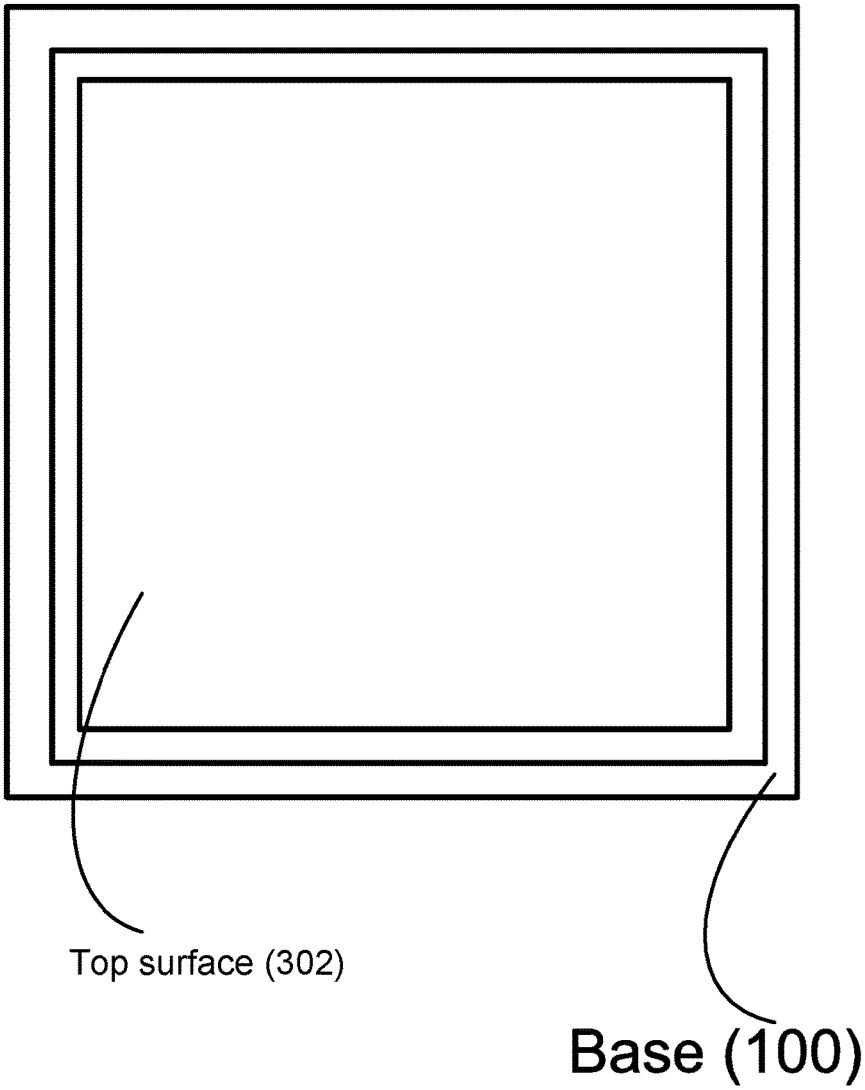
FIG. 2 is for one embodiment, as an example, for square or rectangular "disc" or pad or device or SensiMo Disc.
Figure 3:
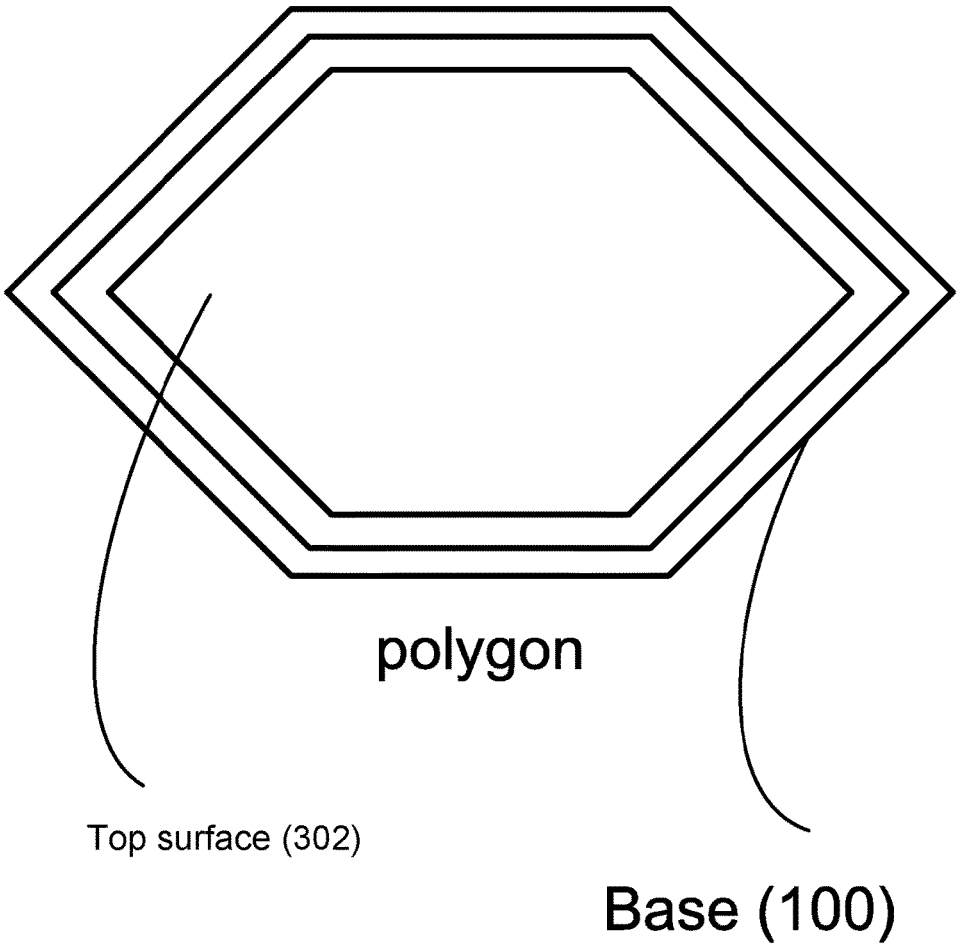
FIG. 3 is for one embodiment, as an example, for polygon "disc" or pad or device or SensiMo Disc, with the active area in a circle in the middle of polygon.
Figure 4:
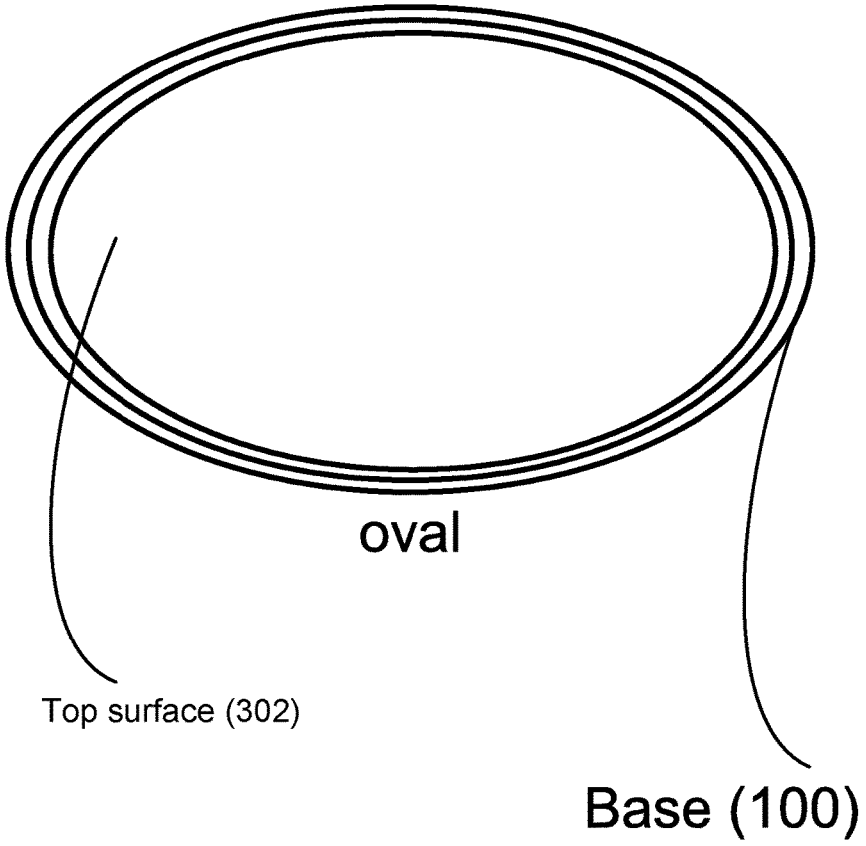
FIG. 4 is for one embodiment, as an example, for oval "disc" or pad or device or SensiMo Disc.

FIG. 1 is for one embodiment, as an example, for circular disc or pad or device or SensiMo Disc. FIG. 2 is for one embodiment, as an example, for square or rectangular "disc" or pad or device or SensiMo Disc. FIG. 3 is for one embodiment, as an example, for polygon "disc" or pad or device or SensiMo Disc. FIG. 4 is for one embodiment, as an example, for oval "disc" or pad or device or SensiMo Disc.

Figure 5:
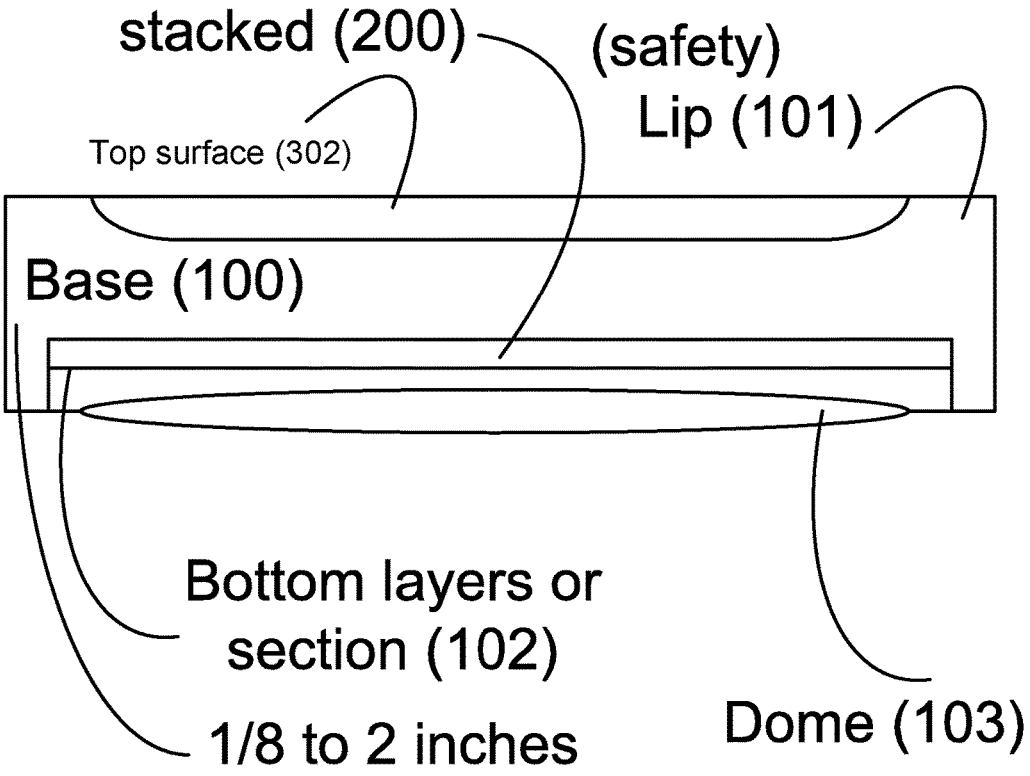
FIG. 5 is for one embodiment, as an example, for cross section of "disc" or pad or device or SensiMo Disc.
Figure 6:
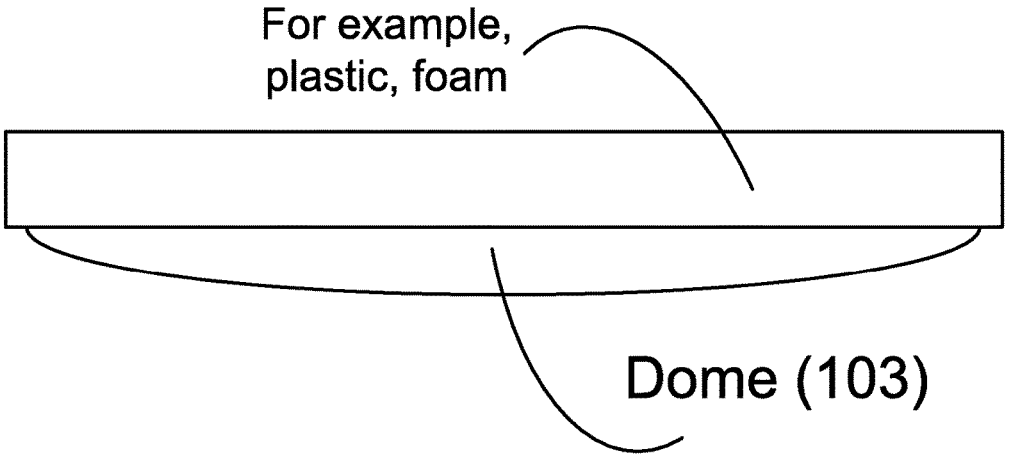
FIG. 6 is for one embodiment, as an example, for dome (103) under "disc" or pad or device or SensiMo Disc.
Figure 7:
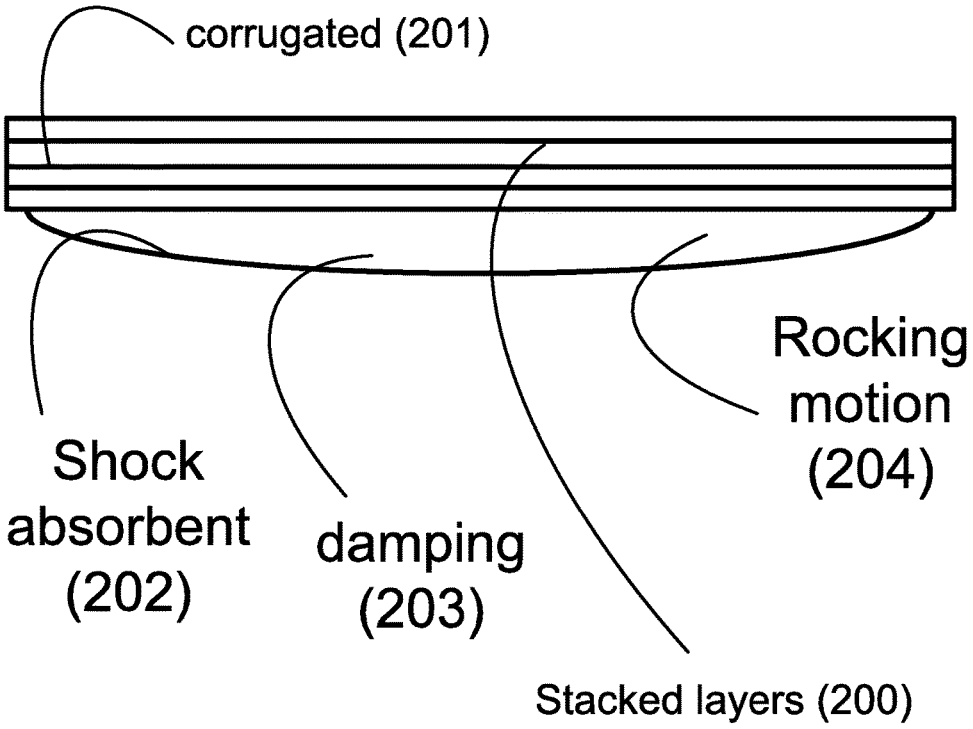
FIG. 7 is for one embodiment, as an example, for rocking motion of "disc" or pad or device or SensiMo Disc.
Figure 8:
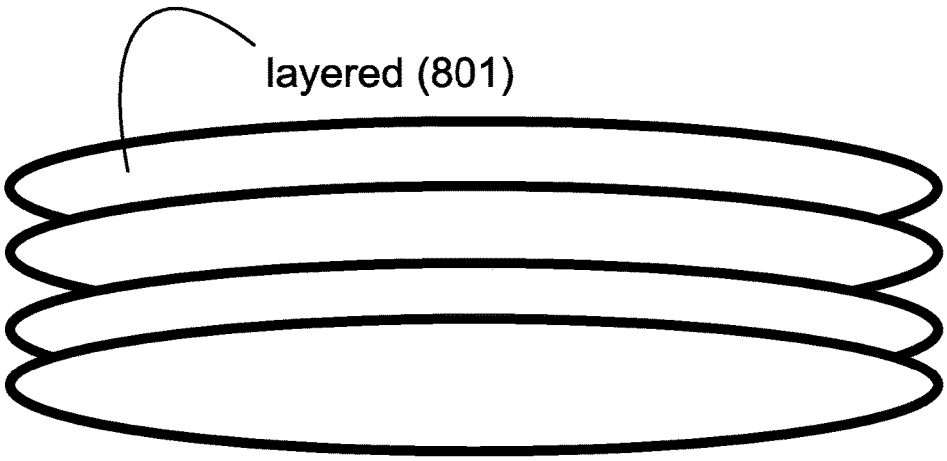
FIG. 8 is for one embodiment, as an example, for multi-rings of "disc" or pad or device or SensiMo Disc.

FIG. 5 is for one embodiment, as an example, for cross section of "disc" or pad or device or SensiMo Disc. FIG. 6 is for one embodiment, as an example, for dome under "disc" or pad or device or SensiMo Disc. FIG. 7 is for one embodiment, as an example, for rocking motion of "disc" or pad or device or SensiMo Disc. FIG. 8 is for one embodiment, as an example, for multi-rings of "disc" or pad or device or SensiMo Disc.

Figure 9:
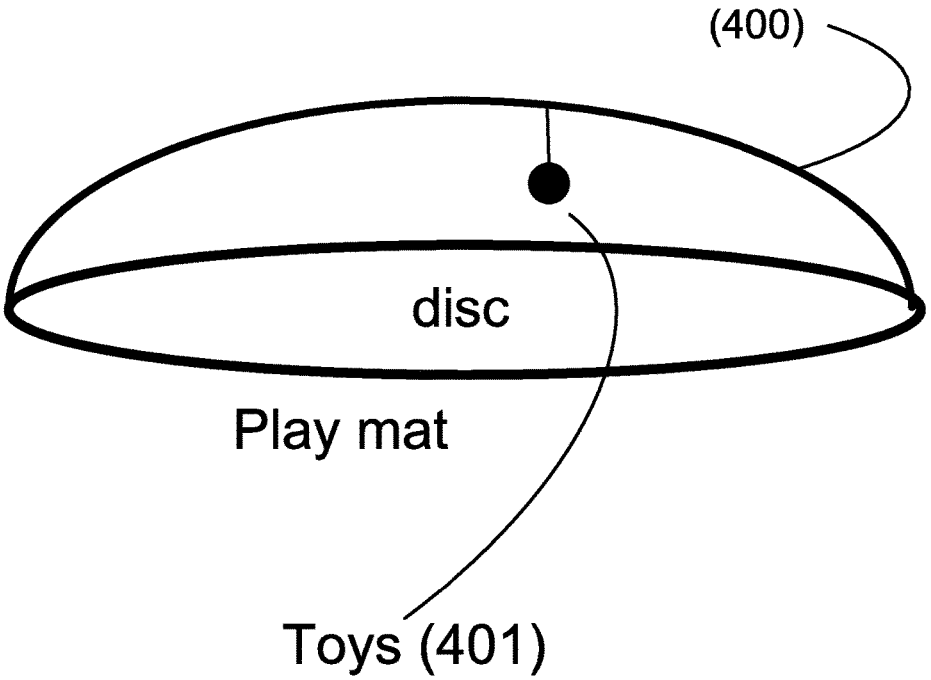
FIG. 9 is for one embodiment, as an example, for toy arc or arch installed on top of "disc" or pad or device or SensiMo Disc.
Figure 10:
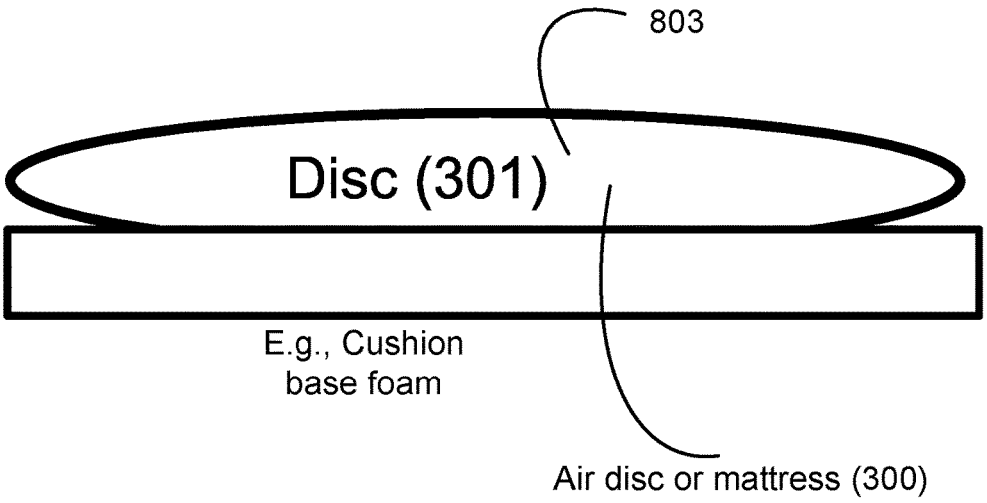
FIG. 10 is for one embodiment, as an example, for wobbly motion of "disc" or pad or device or SensiMo Disc.
Figure 11:
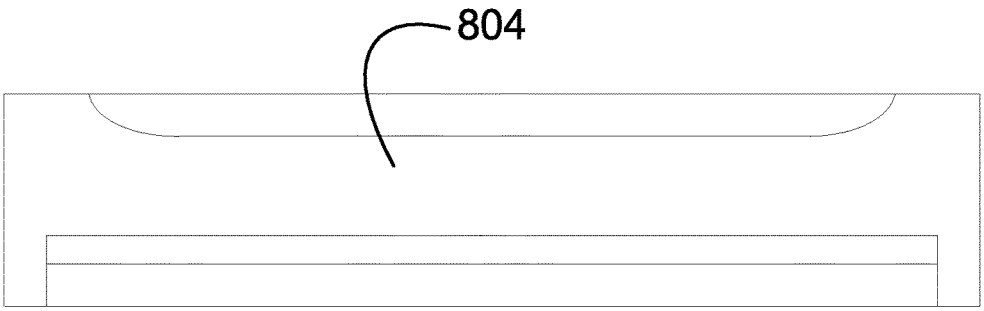
FIG. 11 is for one embodiment, as an example, for pie plate shape of "disc" or pad or device or SensiMo Disc.
Figure 12:
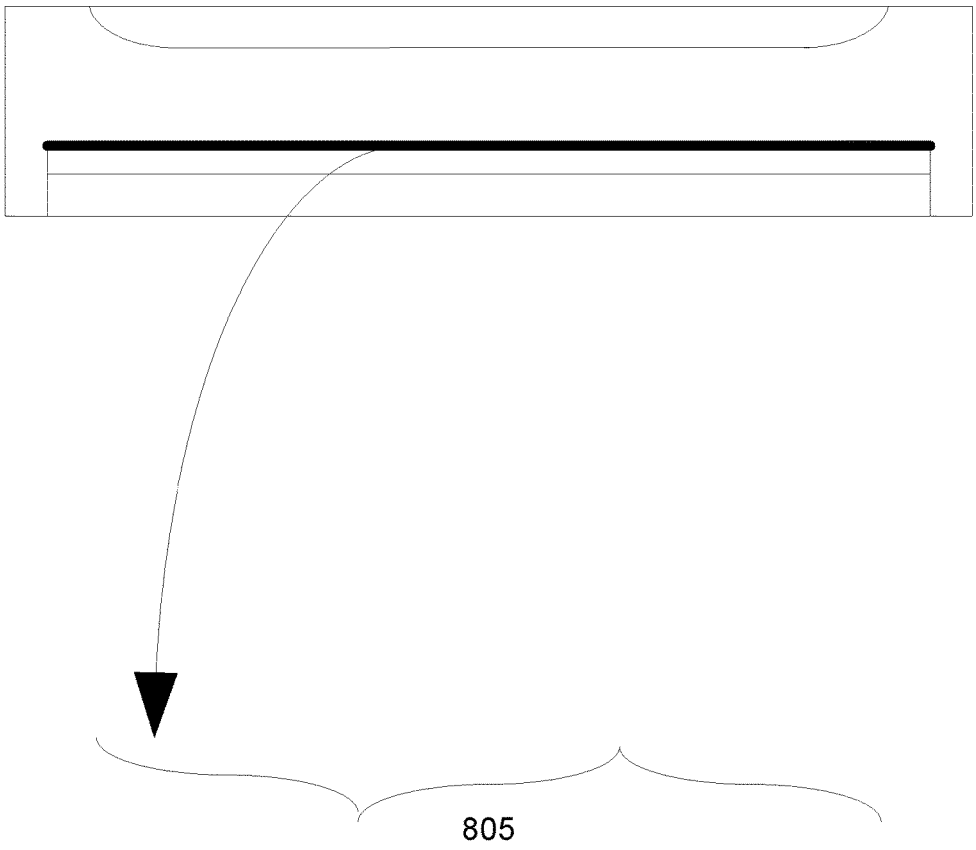
FIG. 12 is for one embodiment, as an example, for sinusoidal interface line for layer(s) of "disc" or pad or device or SensiMo Disc.

FIG. 9 is for one embodiment, as an example, for toy arc or arch installed on top of "disc" or pad or device or SensiMo Disc (toys or attachments or overhead hanging on arch or arc (400), overhead). FIG. 10 is for one embodiment, as an example, for wobbly motion of "disc" or pad or device or SensiMo Disc (wobbly, e.g., sand, air, small balls, foam, plastic, wood particles (803)). FIG. 11 is for one embodiment, as an example, for pie plate shape (804) of "disc" or pad or device or SensiMo Disc. FIG. 12 is for one embodiment, as an example, for sinusoidal interface line (wiggly or sinusoidal shape or periodic shape (805)) for layer(s) of "disc" or pad or device or SensiMo Disc (interface enlarged for better view).

Figure 13:
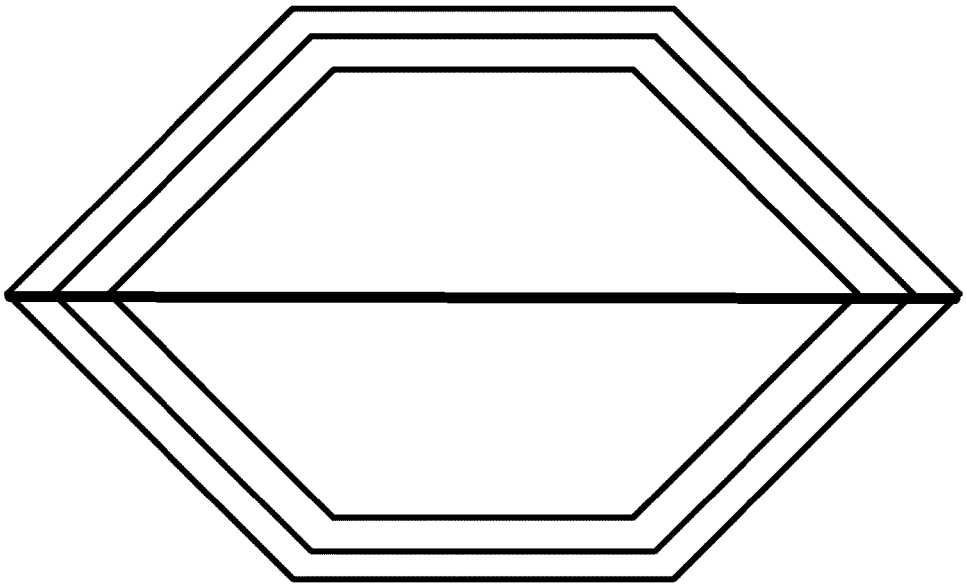
FIG. 13 is for one embodiment, as an example, for folding of "disc" or pad or device or SensiMo Disc.
Figure 14:
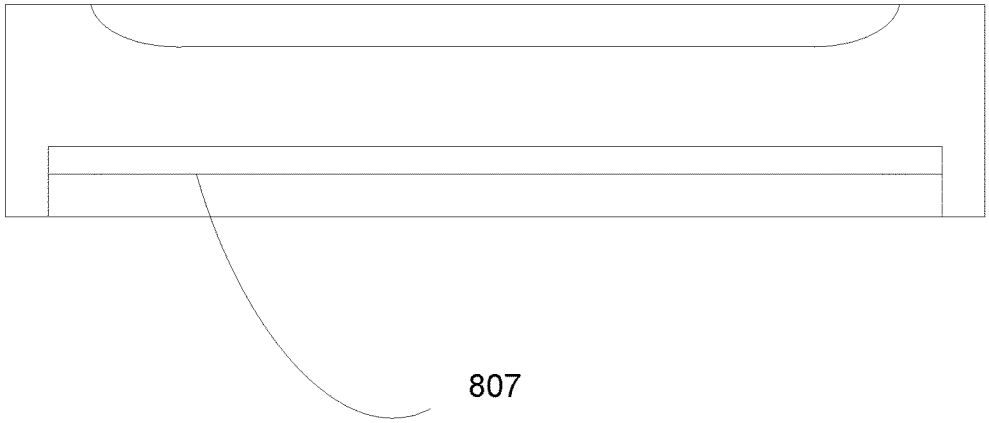
FIG. 14 is for one embodiment, as an example, for fluid layer(s) of "disc" or pad or device or SensiMo Disc.
Figure 15:
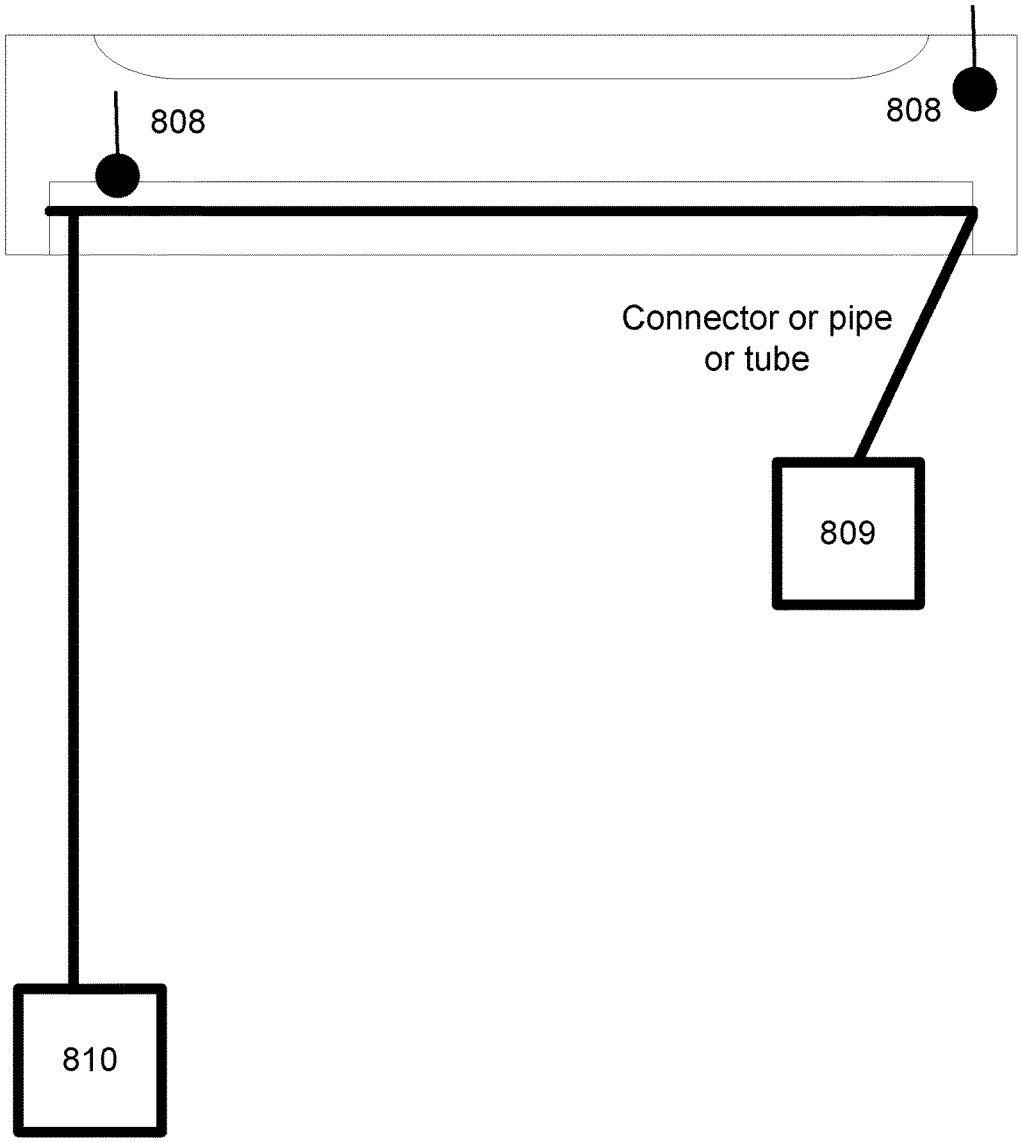
FIG. 15 is for one embodiment, as an example, for tubes inside of "disc" or pad or device or SensiMo Disc.

FIG. 13 is for one embodiment, as an example (polygon, 806), for folding of "disc" or pad or device or SensiMo Disc (folded for storage or carrying). FIG. 14 is for one embodiment, as an example, for fluid layer(s) of "disc" or pad or device or SensiMo Disc (air or fluid or gas or liquid or sand or foam or gelatin type materials/layers/composites/stacked (200)/glued/attached (807)). FIG. 15 is for one embodiment, as an example, for tubes (tubes or pipes, plastic, elastic, or the like, for fluid, gas, air, water, or the like) inside of "disc" or pad or device or SensiMo Disc (air cushion, pillow, layer, tube, ring, enclosure, or container), with wired or wireless sensors for pressure or temperature or both (808), and pump or motor or fluid supply (809), plus storage, overflow, extra, or safety unit (810).

Figure 16:
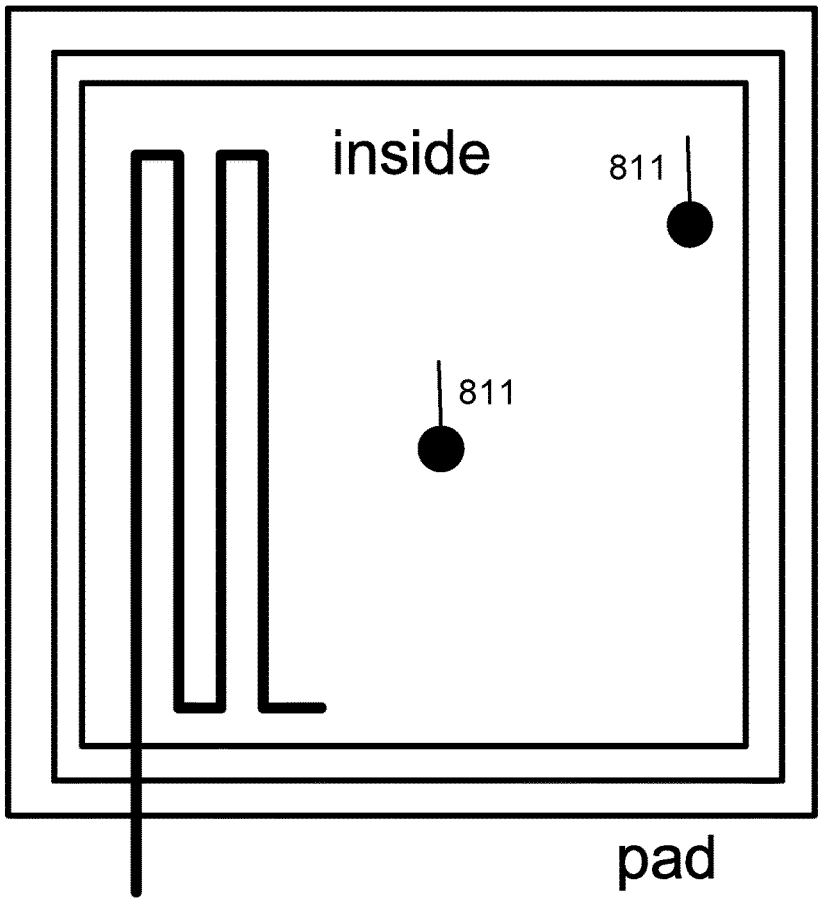
FIG. 16 is for one embodiment, as an example, for tubes and sensors inside of "disc" or pad or device or SensiMo Disc.
Figure 17:
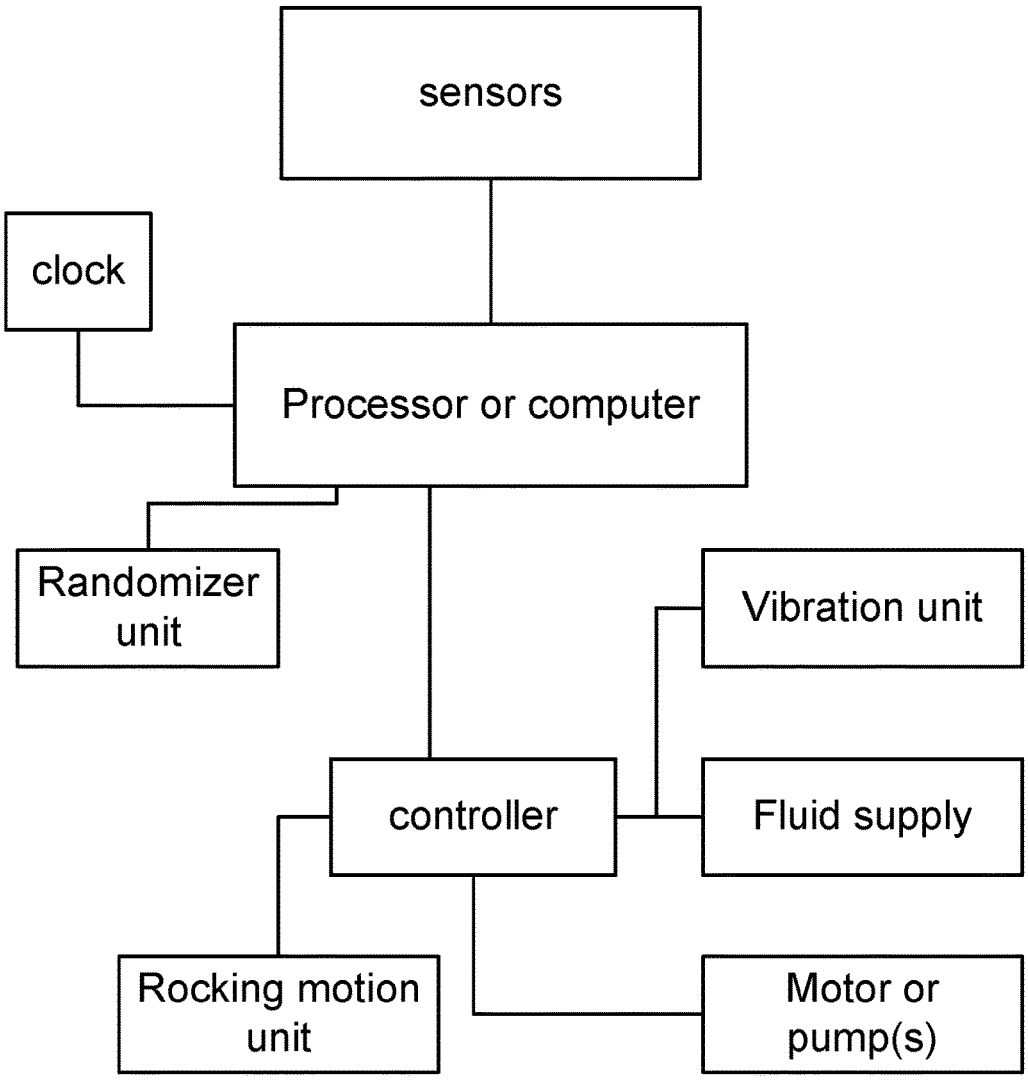
FIG. 17 is for one embodiment, as an example, for system of "disc" or pad or device or SensiMo Disc.

FIG. 16 is for one embodiment, as an example (top view), for tubes (tube or piping, e.g., zigzag or covering the whole area inside the disc) and sensors (wired or wireless sensors for pressure or temperature or both (811)) inside of "disc" or pad or device or SensiMo Disc (to supply or pump or manifold or pressure gauge or valve or controller or cylinder or tank). FIG. 17 is for one embodiment, as an example, for system of "disc" or pad or device or SensiMo Disc.

Figure 18:
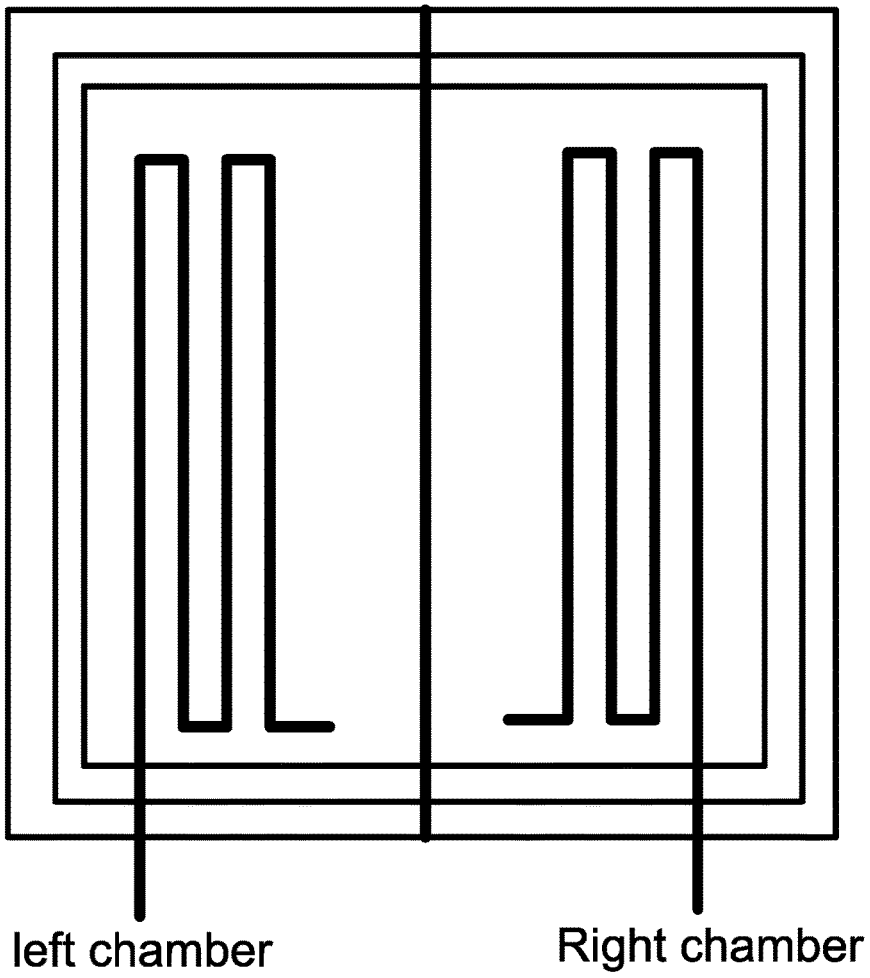
FIG. 18 is for one embodiment, as an example, for two or more chambers separately inside of "disc" or pad or device or SensiMo Disc.

FIG. 18 is for one embodiment, as an example, for two or more chambers (two chambers (or sides or units) with separate spaces, for toggling pressure for fluid or supply, based on time or scheduler or clock, for rocking motion, periodically or randomly) separately inside of "disc" or pad or device or SensiMo Disc.

Figure 19:
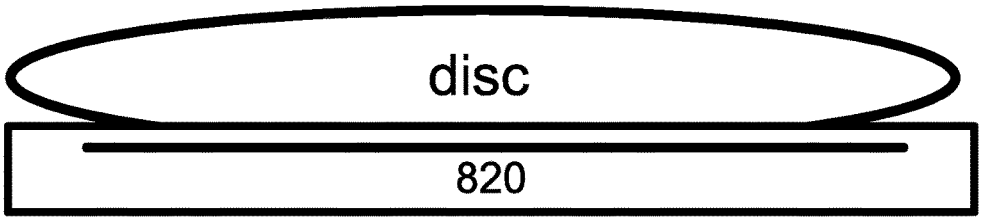
FIG. 19 is for one embodiment, as an example, for railing under the "disc" or pad or device or SensiMo Disc.

FIG. 19 is for one embodiment, as an example, for railing (e.g., low friction rail underneath for rocking (204) motion (820)) under the "disc" or pad or device or SensiMo Disc (wobbly, e.g., sand, air, small balls, foam, plastic, wood particles).

In one embodiment, we have a system of pipes made of plastic or elastic tube for covering the whole area, in back/forth or zig-zag pattern or concentric squares or spiral shapes or concentric circles or mesh or matrix of circles or squares or tile configurations for pipes, with mini-connections between elements, to fill the pipes with liquid, fluid, gas, pressure gas, air, inert gas, water, or similar, in a closed or open system, with or without pump or motor for supply, with or without capped structure.

In one embodiment, we have a system of pipes with some reservoir of the fluid so that with the pressure from baby/weight, the reservoir can supply or get back the extra fluid for later use or re-supply. The valve or one-way valve or manifold or pressure gauge or pressure monitoring device can adjust the pressure manually, or by electrical or mechanical switch or valve, e.g. controlled remotely by the computer or processor or centrally, or by doctor's software or parent's computer monitor, or fully automatic based on a rules engine or a control system.

In one embodiment, we have a system of pipes or tubes or micro-tubes, where the pressure on sides, center, corners, or the like, are periodically switched or increased/decreased, based on a schedule or clock or computer, to rock the baby up and down very slowly and softly.

In one embodiment, we have a system of rollers or balls inside the disc, to make massage or produce movement by pressure, using motor, with chain, belt, lever, or the like, connected to gears, cylindrical rollers, wheels, or balls with rotation axis connected to the chain or belt or the like, for moving by a motor(s), to put pressure or delta pressure between different portions or sides of the disc, periodically or on schedule, to simulate a gentle movement, with a timer.

In one embodiment, we have a system of chambers or boxes of soft material with fluid inside, with or without active or passive or on-demand pump, or no pump, to gradually move the baby around, up/down, or left/right, on 3 different axes or angular coordinates in 3D space. The pump can be always attached to the disc, or can be a generic pump attached, when needed. The music and sound for stimulation can also be added to the system.

In one embodiment, we have the inflatable bottom and non-slippery plastic top, with high coefficient of friction for stability, but still soft material for skin, e.g. cotton or the like.

In one embodiment, we have the pressure or changes or movements as random by random number generator for different sections or areas, for unpredictability for better reaction and preparation of infants. The semi or full random number generator is based on seed generator for random number, which feeds the controller for pressure adjustment based on a timer/clock or processor.

In one embodiment, we have the feedback from the movement of the baby, with pressure sensors on the surface or below the surface, for monitoring or adjusting based on patterns or rules, to counter a pressure on one area, e.g., head movement or rotation, to get back to the controller and processor to adjust the pressure, e.g., pump or fluid supply or pressure, based on localized feedback from sensors.

In one embodiment, we have vibration, massage, rhythmic moves, shaking, or combination of above patterns, selectable by user or parents. In one embodiment, we have vibration with damping exponentially, to reduce the amplitude of movement and deltas, from the equilibrium position/distance.

The shape can be circular or square or rectangle or triangle or pentagon or hexagon or octagon or polygon or non-geometrical shape cross section looking from the top view, e.g., with foam or plastic or cushion or pillow on top. In one embodiment, we have foldable material or hinged or out-of-air package for easy packaging and transporting. In one embodiment, we have jello/gelatin-type material under the surface between 2 layers, e.g. moving on a shaky surface, or multiple of them inside each other, e.g., enclosed or housed inside the other one, for moving surface.

In one embodiment, we have crunchy or sound making material or with bells or music-triggering or notes-making e.g. on metals bouncing on each other or the like, on or inside or outside the disc, for sound stimulation for babies. In one embodiment, we have frame for the structure of the disc on the sides or corners, with or without lips to hold the baby on the sides, with or without legs or anchors to the ground for stability or being stationary, or bosu ball(s) underneath for shaking action. This can be used for healing any injury for kids as well. In one embodiment, we have hard plastic to stand 40-100 lb kids. In one embodiment, we have layers of foam, soft material, and fluids, e.g. air and water. The fluid as hot or cold can also adjust the temperature for the environment for the baby, flowing or staying in the micro or regular tubes. In one embodiment, we have a BPA-free product.

In one embodiment, we have multiple rings or layers on top of each other horizontally, with inflatable rings or air-filled tubes, looking as a solid or semi solid rings, or Swiss Disc or children seat cushion. In one embodiment, we have the diameter or sides as in the range of 1-5 ft., e.g. 3 ft diameter for circle. In one embodiment, we have play mat or arc or arch, with toys (401) that make sound, with colorful design hanging from it, attached at the end of a diameter, on the side, with legs separately or in common, on the top or over of the disc for baby to see (but not touch, for most situations, as an example).

In one embodiment, we have example of ⅛ to ¼ of inch legs. In one embodiment, we have example of ⅛ to ¼ of inch lips for the disc. In one embodiment, we have example of ⅛ to ¼ of inch thickness for each ring, or total. In one embodiment, we have wobbly material, with or without sheets in between, for different examples. In one embodiment, we have thicker or smaller distances or thicknesses.

In one embodiment, we have pie-plate shape for the disc structure. In one embodiment, we have wavy or sinusoidal or curvy or corrugated shape interface or plane for foam or support material horizontally placed in parallel planes, with one or more planes, with hard or soft material, e.g., plastic, or tube or pipe in those planes. In one embodiment, we have the unit that can be folded in 2 to multiple folds or rolls, for compactness for travel or trip, from middle or side. In one embodiment, we have a small inverted dome at the bottom. In one embodiment, we have a dome at the bottom.

In one embodiment, we have plastic as outer ring, with corrugated (201) multi rings on the bottom, with foam or cushion or pillow in between, with Accordion (201) shape or corrugated (201) rings shape for shock absorbent (202) or damping (203) effect for smooth vibration. In one embodiment, we have spring shock absorbent at the corners or in the middle, for damping effect for smooth vibration.

Any variations of the above teaching are also intended to be covered by this patent application.

The invention claimed is:

1. A system for supporting infants and babies, said system consisting essentially of:

a base section;

a lip section;

wherein said lip section is at edges of said base section, to minimize lateral movement of an infant or baby on top surface of said system, located on top of said base section;

wherein said base section comprises an elastic or soft material;

a bottom section;

wherein said bottom section is located under said base section;

wherein said bottom section has multiple layers;

wherein said multiple layers comprise stacked corrugated material, for shock absorbing and pressure damping;

a dome;

wherein said dome is reversely located under said bottom section;

wherein said dome's center part has a higher thickness than said dome's edges, causing rocking motion on said system;

an air mattress, located on said top surface of said system;

wherein said infant or baby lays on said air mattress, to get benefit of said rocking motion on said system.

2. The system for supporting infants and babies as recited in claim 1, said system further consists essentially of: an arc or arch for hanging toys, located outside said base section, and positioned on top of said base section.

* * * * *